US006931675B1

(12) United States Patent
Hager

(10) Patent No.: US 6,931,675 B1
(45) Date of Patent: Aug. 23, 2005

(54) FOOT WASHER

(76) Inventor: Michael Hager, P.O. Box 3597, Pikeville, KY (US) 41502

( * ) Notice: Subject to any disclaimer, the term of this patent is extended or adjusted under 35 U.S.C. 154(b) by 0 days.

(21) Appl. No.: 10/465,420

(22) Filed: Jun. 19, 2003

(51) Int. Cl.[7] ..... A47K 3/022
(52) U.S. Cl. ..... 4/622
(58) Field of Search ..... 4/622, 574.1, 541.1, 4/573.1, 564.1, 578.1; 119/651, 673; 297/423.39, 297/423.41

(56) References Cited

U.S. PATENT DOCUMENTS

| | | | | |
|---|---|---|---|---|
| 335,838 A | * | 2/1886 | Perkins | 4/622 |
| 387,173 A | | 7/1888 | Jeans | |
| 1,060,236 A | | 4/1913 | Dodge | |
| 1,238,349 A | * | 8/1917 | Shreve | 119/437 |
| 1,534,618 A | * | 4/1925 | Taylor et al. | 4/622 |
| 1,970,465 A | | 8/1934 | Martindell et al. | |
| 2,968,814 A | * | 1/1961 | Ashby, Jr. | 4/564.1 |
| 3,393,940 A | * | 7/1968 | Ellsworth et al. | 297/423.41 |
| 3,851,340 A | | 12/1974 | Keusch | |
| 4,184,488 A | * | 1/1980 | Bielich | 601/157 |
| 4,912,786 A | | 4/1990 | Wheelock | |
| 5,173,972 A | | 12/1992 | Goodman | |
| 5,367,720 A | | 11/1994 | Stephens et al. | |
| 5,678,259 A | | 10/1997 | Cruz, Jr. | |
| 5,774,909 A | | 7/1998 | Stable | |
| 5,911,520 A | | 6/1999 | Kenney | |

OTHER PUBLICATIONS

Accurate Tennis Construction, Inc., Tennis Shoe Cleaner, Jun. 17, 2003.
Sun Tennis Pro-Shop, SunTennis, Jun. 17, 2003.
Har Tru Lee Tennis, Shoe Cleaners, Jun. 17, 2003.

* cited by examiner

*Primary Examiner*—Charles E. Phillips
(74) *Attorney, Agent, or Firm*—Wyatt, Tarrant & Combs, LLP

(57) ABSTRACT

A foot washer including a tray for holding water and a removable foot support member for insertion into the tray. The foot support member includes a grid member having a plurality of openings therethrough to thereby allow sand or other particulate debris to fall through the grid member and to the closed bottom of the tray. The grid member is supported by a support member such that the grid member is positioned above the closed bottom and below the open top of the tray. The tray is filled with water in order to submerge the grid member. The grid member is preferably substantially flat. To assist in draining water from the tray, the tray is preferably provided with a spigot.

4 Claims, 2 Drawing Sheets

FOOT WASHER

CROSS REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to devices and methods for cleaning feet.

BACKGROUND OF THE INVENTION

Devices for cleaning feet, which are sometimes known as "foot baths," are known in the art. Examples of foot baths that utilize some type of water holding container include U.S. Pat. No. 1,060,236 (Dodge); U.S. Pat. No. 1,970,465 (Martindell); U.S. Pat. No. 3,851,340 (Keusch); U.S. Pat. No. 4,912,786 (Wheelock); U.S. Pat. No. 5,774,909 (Stable); and U.S. Pat. No. 5,911,520 (Kenny). In the foregoing patents, the feet of the user rest directly on the bottom of the water holding container, such that sand or other debris is not isolated from the foot of the user.

U.S. Pat. Des. 387,173 discloses a portable foot washer that includes a tub or tray, and which differs from the foregoing prior art in that it includes what appears to be a soft rubber mat resting directly on the bottom of the tray. As shown in FIG. 7, the mat appears to have openings therethrough. The mat is not elevated above the closed bottom, is not supported by anything other than the bottom of the tray, and does not appear to be removable. In this configuration, the feet are not isolated from the sand or other particulate debris. The tray does not include a spigot for draining water from the tray.

U.S. Pat. No. 5,678,259 (Cruz) discloses a foot washing system that includes a plurality of compartments. The first compartment includes a removable piece of rug 48 for use in cleaning the sole of the foot of a user. The rug rests directly on the closed bottom of the compartment and is held in place by hook and loop fasteners 46, 50 (i.e. VELCRO). See Col. 4, lines 54–67. The rug is not elevated above the closed bottom, is not supported by anything other than the bottom of the compartment, and the feet remain in close proximity to the sand or other particulate debris. It appears that the first compartment is not intended to hold water, because the second compartment is designed for actual washing of the foot. The first container does not contain a spigot for draining water from the tray.

U.S. Pat. No. 5,173,972 (Goodman) and U.S. Pat. No. 5,367,720 (Stephens) both disclose foot washing devices that include a foot support member having openings therethrough. Goodman and Stephens do not disclose the use of a tray for holding water, but instead use fairly complicated arrangements for spraying water over feet while the feet are supported on the foot support member. The water then immediately drains through the openings, rather than being retained in a surrounding tray.

There is thus a need for a device for washing feet having the following characteristics and advantages over the prior art.

OBJECTS AND SUMMARY OF THE INVENTION

It is an object of the invention to provide a device and methods for washing sand or other particulate debris from the feet of a user that includes an elevated foot support member in order to isolate sand and other particulate debris from the foot of the user. It is a further object of the invention to provide a foot washer that is not complex and that can be readily disassembled for cleaning, transport, or storage.

The foot washer device of the invention includes a tray configured to hold water and a removable foot support member for insertion into the tray. Because the foot support member is removable, the foot washer can be readily disassembled for cleaning, storage or transport. The tray has a closed bottom, an upstanding side wall extending around the closed bottom, and a substantially open top. The open top is sized to allow a user to place a foot through the opening. To assist in draining water from the tray, the tray is preferably provided with a spigot. If the spigot is provided with a water hose connection, the spigot can also be used to selectively fill the tray with water.

The foot support member includes a grid member for receiving a foot of the user. The grid member has a plurality of openings therethrough to thereby allow sand or other particulate debris to fall through the grid member and to the closed bottom of the tray. In a preferred embodiment, the grid member is sized to simultaneously receive both of the feet of the user. The grid member is preferably sized to fit closely against an inner surface of the sidewall of the tray, in order to prevent a user from slipping a foot below the grid member. The grid member is preferably substantially flat.

The grid member is supported by a support member. The grid support member is sized and configured such that when a bottom portion of the support member rests on the closed bottom of the tray, the grid member is positioned above the closed bottom and below the open top of the tray. With the grid member positioned in this manner, the tray can be selectively filled with water in order to submerge the grid member. With the grid member submerged in the water, a user can clean sand or other particulate debris from his or her feet by simply setting a foot on the grid member. The water cleans sand and other particulate debris from the foot, with the exception of sticky items that are not water soluble. The surface of the grid can also assist in removing sand and particulate debris. As the foot is rubbed or dragged along the grid, sand or other particulate debris is scraped from the foot and falls through the plurality of openings in the grid. Because of the elevated grid member, the foot remains isolated from removed sand and other non-soluable particulate debris.

The foregoing and other objects, features, aspects and advantages of the invention will become more apparent from the following detailed description of the invention when considered in conjunction with the accompanying drawings.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
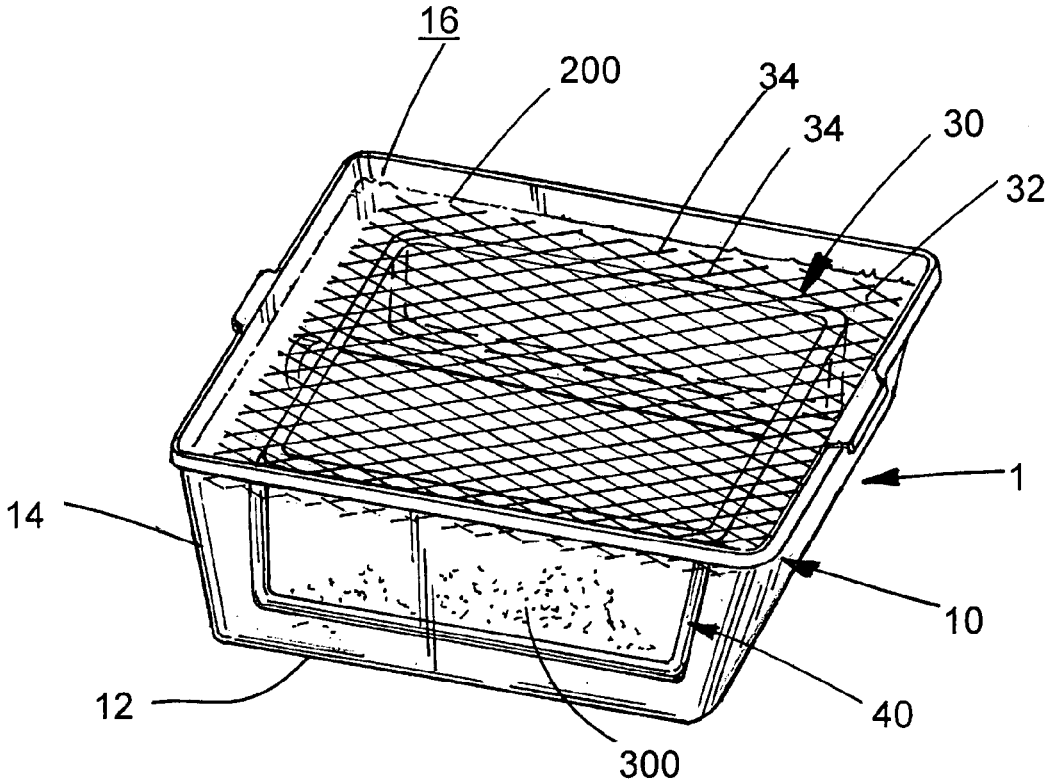
FIG. 1 is a perspective view of one preferred embodiment of the invention.

The invention 1 is a device for washing sand or other particulate debris from the feet of a user. The invention 1 is designed primarily for use in sandy environments, such as the beach, where individuals frequently need to clean sand or other particulate debris from their feet prior to entering a building or a vehicle. As shown in FIG. 1, the invention includes a tray 10 configured to hold water 90. The tray 10 has a closed bottom 12, an upstanding side wall 14 extending around the closed bottom 12, and a substantially open top 16. The open top 16 is sized to allow a user 100 to place a foot through the opening 16, in the manner shown in FIG. 2. The tray 10 is preferably about 24 inches long. The tray 10 is preferably a plastic tray, such as the type conventionally available for storing and transporting items.

Figure 2:
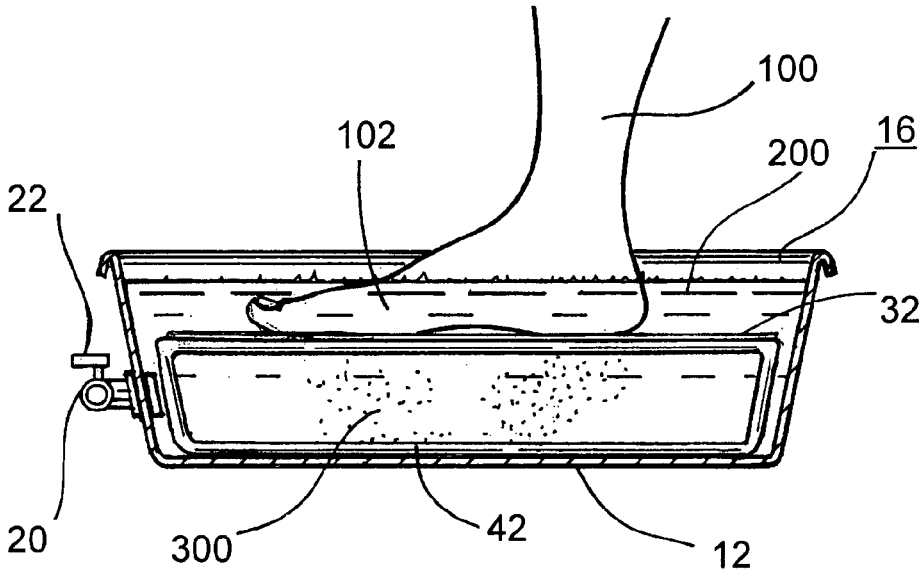
FIG. 2 is a cross-section side view of one preferred embodiment of the invention.

As shown in FIGS. 1 and 2, a removable foot support member 30 is provided for the tray 10. The foot support member 30 includes a grid member 32 for receiving a foot 102 of the user 100. The grid member 32 has a plurality of openings therethrough to thereby allow sand or other particulate debris 300 to fall through the grid member 32 and to the closed bottom 12 of the tray 10. As shown in FIG. 1, the plurality of openings in the grid member 32 are preferably formed from a grating of crossed bars 34, such as in the manner of a conventional steel grate. In the preferred embodiment shown in FIG. 1, the grid member 32 is sized to simultaneously receive both of the feet 102 of the user 100. As shown in FIGS. 1 and 2, the grid member 32 is preferably sized to fit closely against an inner surface of the sidewall of the tray, in order to prevent a user from slipping a foot below the grid member 32. As shown most clearly in FIG. 2, the grid member 32 is preferably substantially flat.

The grid member 32 is supported by a support member 40. As shown most clearly in FIG. 2, the support member 40 is sized and configured such that when a bottom portion 42 of the support member 40 rests on the closed bottom 12 of the tray 10, the grid member 32 is positioned above the closed bottom 12 and below the open top 16 of the tray 10. With the grid member 32 positioned in this manner, the tray 10 can be selectively filled with water 200 in order to submerge the grid member 32, as shown in FIG. 2. With the grid member 32 submerged in the water 200, a user 100 can clean sand or other particulate debris 300 from his or her feet by simply setting a foot 102 on the grid member 32. The water 200 cleans sand and other particulate debris 300 from the foot 102, with the possible exception of sticky items that are not water soluble. The surface of the grid 32 can also assist in removing sand and particulate debris 300, such as debris that tends to stick to the feet. As the foot 102 is rubbed or dragged along the grid 32, sand or other particulate debris is scraped from the foot 102 and falls through the plurality of openings in the grid.

As shown in FIG. 2, to assist in draining water from the tray 10, the tray 10 is preferably provided with a spigot 20. The spigot 20 extends through the side wall 14 of the tray 10 for use in selectively draining water 200 from the tray 10. The spigot 20 has an external shutoff means 22, such as a handle, to allow a user 100 to selectively open or close an internal valve of the spigot 20. If the spigot 20 is provided with a water hose connection, the spigot can also be used to selectively fill the tray with water.

Figure 3:
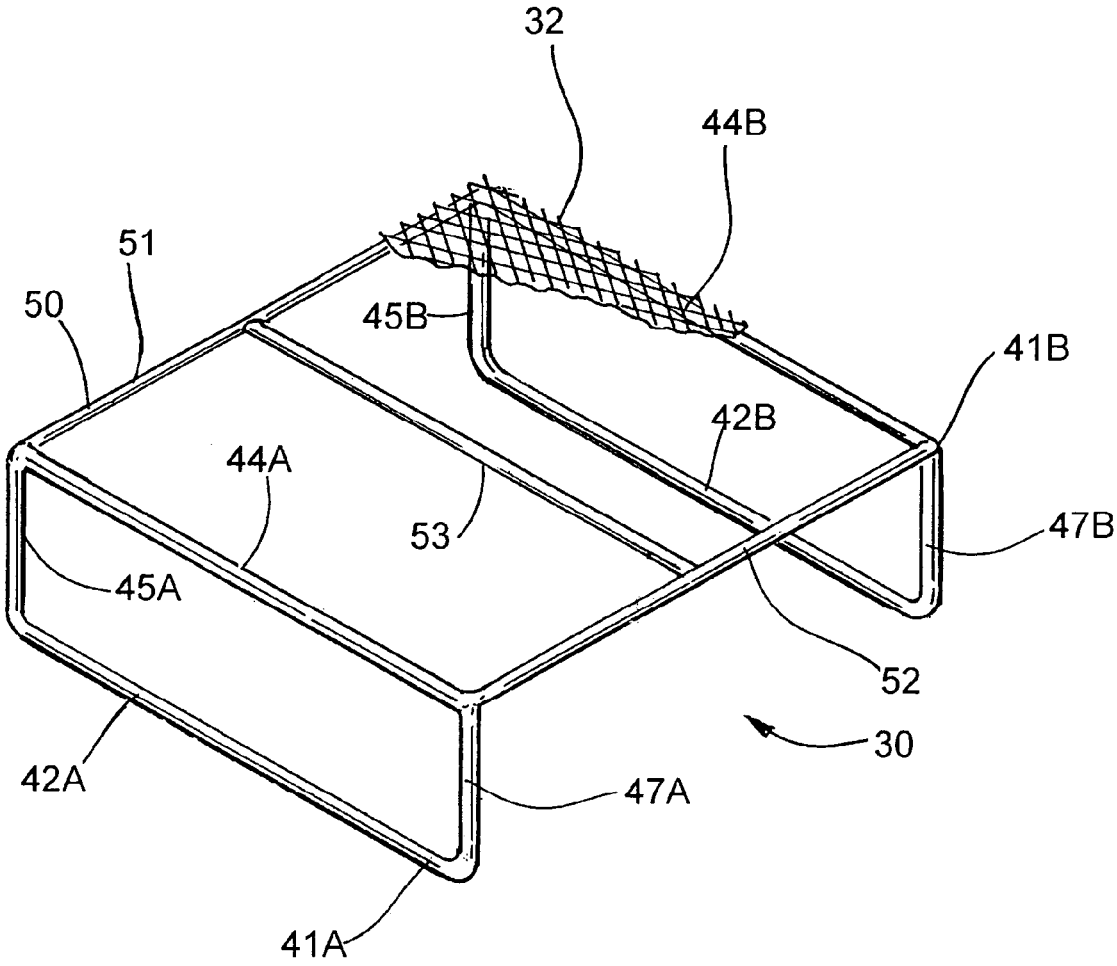
FIG. 3 is a top-side perspective view of one preferred embodiment of the foot support member of the invention.

FIG. 3 shows details of a preferred embodiment of a removable foot support member 30. In the preferred embodiment of FIG. 3, the foot support member 30 has a first and a second leg member 41A, 41B. Each leg member 41A, 41B has a lengthwise upper bar 44A, 44B and a lengthwise lower bar 42A, 42B. As shown in FIG. 3, the upper 44A and lower 42A bars of the first leg member 41A are fixed to one another in a substantially parallel relationship by a pair of support legs 45A, 47A. Likewise, the upper 44B and lower 42A bars of the second leg member 41B are fixed to one another in a substantially parallel relationship by a pair of support legs 45B, 47B. The upper bar 44A of the first leg member 41A and the upper bar 44B of the second leg member 41B are fixed to one another in a substantially parallel relationship by a first 51 and a second 52 support bar. Together, the upper bars 44A, 44B and the first and second support bars 51, 52 form a support surface 50. A reinforcement bar 53 is preferably fixedly connected to the first 51 and the second 52 support bars to reinforce the support surface 50. In the preferred embodiment shown in FIG. 3, the reinforcement bar 53 is positioned between the upper bar 44A of the first leg member 41A and the upper bar 44B of the second leg member 41B. FIG. 3 further shows a cut-away portion of a substantially flat grid member 32 fixedly attached to the support surface 50, such as by welding.

In operation, the invention 1 can be conveniently used in any situation in which it is desirable to clean sand or other particulate debris 300 from the feet of a user 100, such as upon returning to a beach house after a visit to the beach. The foot support member 30 is placed inside the tray 10 so that the bottom 42 of the support member rests on the closed bottom 12 of the tray 10. The tray 10 is filled with water 200 until the grid member 32 is submerged under the surface of the water. The user 100 then places a foot 102 on the grid member 32 in order to submerge the foot in the water 200. The water 200 washes sand or other particulate debris 300 from the foot 102. The sand or other particulate debris 300 falls through the grid 32 and settles on the bottom 12 of the tray 10. When finished, the water 200 can be poured from the tray 10 or drained out through the spigot 20. The tray 10 and foot support member 30 can be conveniently stored until needed, such as in the trunk of a car or the supply room of a beach house. Because the foot support member 30 is removable, it is easy to clean and store the components of the device. Additionally, the foot support member 30 can be used with different trays 10, thus eliminating the need to transport trays 10 from one location to another.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A device for washing sand or other particulate debris from the feet of a user comprising:

a tray configured to hold water, said tray having a closed bottom, an upstanding side wall extending around said closed bottom, and a substantially open top, a removable foot support member for insertion into said tray, said removable foot support member comprising:

a first leg member, said first leg member having a lengthwise upper bar and a lengthwise lower bar, said upper and lower bars fixed to one another in a substantially parallel relationship by a pair of support legs, a second leg member, said second leg member having a lengthwise upper bar and a lengthwise lower bar, said upper and lower bars fixed to one another in a substantially parallel relationship by a pair of support legs, said upper bar of said first leg member and said upper bar of said second leg member fixed to one another in a substantially parallel relationship by a first and a second support bar, said upper bars and said support bars together forming a support surface, a reinforcement bar fixedly connected to said first and said second support bars to thereby reinforce said support surface, said reinforcement bar positioned between said upper bar of said first leg member and said upper bar of said second leg member, and a substantially flat grid member fixedly attached to said support surface, said grid member having a plurality of openings therethrough to thereby allow sand or other particulate debris to fall through said grid member, said grid member sized to simultaneously receive both feet of the user.

2. The device of claim 1, wherein said grid member is sized to fit closely against an inner surface of said sidewall of said tray, to thereby prevent the user from slipping a foot below said grid member.

3. The device of claim 1, further comprising a spigot extending through said side wall of said tray for use in selectively draining water from said tray.

4. The device of claim 1, further comprising water in said tray, said water covering said grid member to thereby allow the user, upon setting a foot on said grid member, to submerge at least a sole of the foot in said water.

* * * * *